United States Patent [19]

Beuther et al.

[11] 4,179,474

[45] Dec. 18, 1979

[54] PROCESS FOR CONVERSION OF NAPHTHA TO ETHYLENE

[75] Inventors: Harold Beuther, Cheswick; Harold E. Swift, Gibsonia, both of Pa.

[73] Assignee: Gulf Research and Development Company, Pittsburgh, Pa.

[21] Appl. No.: 863,404

[22] Filed: Dec. 22, 1977

[51] Int. Cl.[2] ..... C07C 5/04

[52] U.S. Cl. ..... 585/251; 208/57; 208/61; 585/650

[58] Field of Search ..... 260/683 R; 208/143, 208/144, 57, 61

[56] References Cited

U.S. PATENT DOCUMENTS

| | | | |
|---|---|---|---|
| 3,708,550 | 1/1973 | Beuther et al. | 260/680 R |
| 3,848,017 | 11/1974 | Shalit | 260/683 R |
| 3,907,920 | 9/1975 | Starks | 208/89 |

*Primary Examiner*—O. R. Vertiz
*Assistant Examiner*—Wayne A. Langel

[57] ABSTRACT

A catalytically hydrogenated naphtha stream containing less than 10 ppm by weight of sulfur is pyrolyzed without added hydrogen to a product including ethylene. Selectivity to ethylene is increased by adding a sulfur compound to increase the sulfur content to above 20 ppm by weight based on hydrogenated naphtha. Addition of the sulfur compound increases the quality of hydrogenated naphtha as a pyrolysis feedstock nearly to that of a $C_2$ to $C_5$ paraffin stream.

25 Claims, No Drawings

PROCESS FOR CONVERSION OF NAPHTHA TO ETHYLENE

This invention relates to a process for the pyrolysis of hydrogenated naphtha to produce a cracked product including ethylene.

This invention can be applied to the pyrolysis of straight run naphtha but has particular utility in regard to the pyrolysis of catalytically cracked, thermally cracked and/or coker naphtha. Catalytically cracked, thermally cracked and coker naphthas all have relatively high olefinic and aromatic contents and are therefore unsatisfactory pyrolysis feedstocks unless they are first hydrotreated.

The pyrolysis operation of the present invention is performed without added molecular hydrogen and without a catalyst and can be carried out in a coil furnace. The pyrolysis operation does not require the use of inert hot solids as a heat source. However, if desired, the pyrolysis operation can be performed in a riser without a furnace, utilizing entrained catalytically inert hot solids as a heat source.

It is known that a stream of normal and iso non-cyclic paraffins, such as pentanes, constitutes a high quality pyrolysis feedstock, providing high ethylene and low coke yields. A stream comprising naphtha, especially cracked naphtha and coker naphtha, constitutes a lower quality pyrolysis feedstock because such naphtha contains a significant amount of olefins, naphthenes and aromatics which are more refractory than non-cyclic paraffins and have a greater tendency to be converted to coke at pyrolysis temperatures.

The naphtha feedstock of this invention primarily comprises materials boiling within the range 80° to 450° F. (27° to 232° C.), and especially within the range 110° to 185° F. (43 to 85° C.).Even if thermally cracked and coker naphthas are hydrogenated, they are not acceptable for use as gasoline unless they are leaded, and leaded fuels cannot be employed in late model automobile engines. Therefore, the use of hydrotreated thermally cracked and coker naphthas as pyrolysis feedstocks represents an important present day use of these naphthas.

Cracked naphtha and coker naphtha can be upgraded considerably as pyrolysis feedstocks by catalytic hydrogenation. The hydrogenation operation converts olefins to paraffins while naphthenes and aromatics are converted to cycloparaffins, thereby improving the cracking susceptibility and diminishing the coking susceptibility of these materials. The conditions of the hydrogenation operation are sufficiently mild that little or no opening of cycloparaffinic rings or other hydrocracking occurs. For example, not more than 10 or 20 volume percent of the naphtha is converted to material boiling below the IBP of the total naphtha feedstock during the naphtha hydrotreating operation.

While it would be expected that the conversion of the aromatic content of naphthas to cycloparaffins via hydrogenation would constitute an upgrading of such naphthas as pyrolysis feedstocks, it would also be expected that without hydrocracking to open the cycloparaffinic ring structures the hydrogenated naphthas would be inferior to non-cyclic paraffins as pyrolysis feedstocks. In accordance with the present invention it has been discovered that cycloparaffinic hydrogenated naphtha pyrolysis feedstocks can be upgraded nearly to the status of non-cyclic paraffinic pyrolysis feedstocks without recourse to hydrocracking to open cycloparaffinic ring structures by adding a sulfur-containing compound thereto. It has now been discovered that the injection of a sulfur-containing compound unexpectedly increases ethylene selectivity during pyrolysis of a hydrogenated naphtha containing more than 10, 20 or 30 volume percent of cycloparaffins. The introduction of an extraneous sulfur-containing compound upgrades a cycloparaffinic hydrogenated naphtha feedstock nearly to the quality of a non-cyclic paraffinic feedstock without consuming the hydrogen that would otherwise be required to hydrocrack the cycloparaffinic structures to non-cyclic paraffins.

Hydrogenated cracked and coker naphthas generally contain less than about one volume percent of olefins plus aromatics and less than about 10 ppm by weight of sulfur. In accordance with this invention a sulfur compound is added to the hydrogenated naphtha so that there is more than 20 ppm by weight of sulfur based on hydrogenated naphtha in the pyrolysis zone. For example, the sulfur content is increased so that there is between about 20 and 1,000 ppm by weight of sulfur, generally; between about 50 and 800 ppm by weight of sulfur, preferably; and between about 75 and 500 ppm by weight of sulfur, most preferably, based on hydrogenated naphtha.

Any suitable sulfur compound can be added. A suitable but non-limiting list of sulfur compounds includes hydrogen sulfide, organo-mercaptans such as methanethiol, ethyl mercaptan, propyl mercaptan, n-butyl mercaptan, octyl mercaptan, hexyl mercaptan, and the like; aryl mercaptans such as phenyl mercaptan, naphthyl mercaptan, and the like; organo-sulfides such as methylthioethane, phenylthioethane, carbon disulfide, and the like; the organosulfoxides such as dimethyl sulfoxide, methyl sulfonyl ethane, and the like; organosulfones such as diethyl sulfone, methyl sulfonyl ethane, phenyl sulfonyl ethane, and the like.

The temperature in the pyrolysis coil of this invention is between about 1,300° and 2,300° F.(704° and 1,260° C.), generally, between about 1,400° and 2,000° F. (760° and 1,083° C.), preferably, and between about 1,430° and 1,850° F. (777° and 1,010° C.), most preferably. Immediately upon leaving the coil, the product stream should be quenched to a temperature below 1,300° F. (704° C.). A quench temperature between about 890° and 1,300° F. (477° and 704° C.) is suitable.

A dispersant gas, preferably steam, is supplied to the pyrolysis coil, if desired, in any amount up to about 2 pounds per pound (908 gm. per gm.) of hydrocarbon feed. Although the use of steam favorably influences ethylene yield and selectivity, it is a costly factor in cracker operation and the amount of steam required can be reduced by the addition of a sulfur compound in accordance with this invention.

The pressure in the pyrolysis coil should be adequate to force the riser effluent stream through downstream product separation equipment. The pressure can be between about 3 and 100 psi (0.2 and 7 kg/cm$^2$), generally, and between about 5 and 50 psi (0.35 and 3.5 kg/cm$^2$), preferably. A pressure above about 15 psi (1.05 kg/cm$^2$) will usually be required. The coil residence time can be between about 0.05 and 2 seconds, generally, or between about 0.05 and 0.5 seconds, preferably. If a riser employing hot solids is employed, the operating conditions will be similar to those employed for coil furnace cracking except that pyrolysis heat is supplied by hot, inert solids rather than by a furnace.

During pyrolysis, coke is deposited on the hot solids which are passed to a combustion zone where the coke is burned from the solids, thereby reheating the solids for recycle to the pyrolysis zone.

We have found that an enhanced ethylene yield is achieved by employing sulfur injection even when ethane or other cracked products are not recycled, although ethane and other cracked products can be recycled, if desired. In order to encourage the pyrolysis dehydrogenation of ethane to ethylene, molecular hydrogen is not added to the pyrolysis zone and the pyrolysis operation is performed without any hydrogenation catalyst or other catalytic entity. A reason for operating the pyrolysis zone at a pressure which is as low as is practical is to maintain the pressure of molecular hydrogen prodced in the pyrolysis operating at a low level. A low hydrogen pressure advantageously discourages hydrogenation of ethylene to ethane so that the once-through yield of ethylene on a weight basis will be 3, 4 or 5 times, or more, than the yield of ethane.

As indicated above, it is known that non-cyclic paraffins constitute a high quality pyrolysis feedstock. A stream containing normal or iso non-cyclic paraffins from the $C_2$ to $C_5$ group constitutes a particularly suitable pyrolysis feedstock. Pyrolysis of these materials is known to provide a high ethylene selectivity with a low coke yield. A low coke yield is particularly important operationally because deposits of coke upon the inner wall of a pyrolysis coil interfere with heat transfer across the coil, requiring frequent downtimes for reaming or combustion of the coke from the coil, thereby reducing the length of the pyrolysis cycle. Because lower quality pryolysis feedstocks, such as higher molecular weight or cyclic materials, produce a higher coke yield, such materials generally exert a deleterious effect when blended with a feed stream comprising $C_2$ to $C_5$ non-cyclic paraffins. The higher coke yield resulting from introducing these materials to a $C_2$ to $C_5$ paraffinic feedstock shortens the process cycle and therefore tends to reduce the operational attractiveness of the non-cyclic paraffin feedstock.

Data presented below show that at a given cracking temperature the pyrolysis of pentane results in a lower coke yield than the pyrolysis of hydrogenated coker naphtha. This finding is expected because of the presence of a higher level of cycloparaffins in a hydrogenated coker naphtha stream than in a pentane stream. However, data presented below show that the addition of a sulfur compound to a hydrogenated coker naphtha pyrolysis feedstock reduces the coke yield obtained upon pyrolysis to about the same coke yield as is obtained upon pyrolysis of pentanes at a comparable temperature.

We have discovered that hydrogenated cracked or coker naphtha containing more than 10, 20 or 30 volume percent of cycloparaffins together with an added sulfur compound can be blended with a normal or isoparaffinic pyrolysis feedstock boiling in the naphtha range containing less than 10 volume percent of cycloparaffins or with a stream containing $C_2$ to $C_5$ paraffins containing less than 10 volume percent of cycloparaffins without significantly increasing the coke yield. It is because of the addition of the sulfur compound that the coke yield, and therefore the pyrolysius cycle length for a given throughput, is about the same when employing the blended feedstock as when employing the low cycloparaffin feedstock alone. Furthermore, the sulfur compound enhances the ethylene yield from the high cycloparaffinic portion of the blend. In addition, the yield of valuable aromatics, including benzene, toluene and xylene, is higher from the blend than it is from the low cycloparaffinic feedstock alone, apparently because some of the cycloparaffinic content of the hydrogenated naphtha is aromatized to these aromatics. Thereby, use of the blend improves the mix of valuable products from the process.

Table 1 shows the results of once through pyrolysis tests employing three different feedstocks, including a stream comprising pentanes, a stream comprising non-hydrogenated coker gasoline and a stream comprising hydrogenated coker gasoline. These tests were performed at the various temperatures indicated in Table 1 in a coil passing through a furnace with a 0.75 weight ratio of steam to hydrocarbon. The pentane feedstock contained 5.46 volume percent of cycloparaffins, the remainder being non-cyclic $C_5$ paraffins. The composition of the coker gasoline was typical of coker and cracked gasolines. These gasolines generally contain about 5 to 10 volume percent aromatics, about 44 to 50 volume percent olefins, and the rest naphthenes. The hydrogenation conditions used in preparing the hydrogenated coker gasoline feedstock included a temperature of 688° F. (364° C.), a pressure of 1250 psi (87.5 kg/cm$^2$), a LHSV of 1.0, a gas rate of 750 SCF/B (135 SCM/100L) of a stream comprising 80 percent hydrogen, and a hydrogen consumption of 600 SCF/B (10.8 SCM/100L). The non-hydrogenated coker gasoline had an over point of 131° F. (55° C.), an end point of 336° F. (169° C.), and a mean average boiling point of 219° F. (104° C.). The hydrogenated coker gasoline had an over point of 131° F. (55° C.), an end point of 349° F. (176° C.), and a mean average boiling point of 223° F. (106° C.). Therefore, very little hydrocracking occurred during the hydrotreatment and essentially no material was cracked to a temperature below the IBP of the feedstock. The composition of the hydrogenated coker gasoline is shown in Table 2.

Table 2

| | Volume Percent |
|---|---|
| Total paraffins | 65.3 |
| Monocycloparaffins | 32.6 |
| Dicycloparaffins | 1.6 |
| Aromatics | 0.5 |

Table 2 shows that the hydrogenated coker gasoline comprised a total of 34.2 volume percent cycloparaffins, and was almost entirely paraffinic in nature. Therefore, the hydrotreatment operation accomplished saturation of substantially all unsaturated materials in the coker gasoline without essentially any hydrocracking, as indicated by an essentially constant mean average boiling point.

Table 1

PYROLYSIS DATA

| | Hydrogenated Coker Gasoline | | | | Non-Hydrogenated Coker Gasoline | Pentanes | | | |
|---|---|---|---|---|---|---|---|---|---|
| Temp. ° C. (° F.) | 836 (1537) | 847 (1557) | 858[d] (1576) | 877 (1611) | 832 (1530) | 834 (1533) | 843 (1550) | 853 (1567) | 864 (1587) |
| $H_2$[a] | 0.96 | 0.99 | 1.07 | 1.19 | 0.80 | 0.93 | 1.02 | 1.12 | 1.19 |
| $CH_4$ | 15.35 | 16.28 | 17.61 | 19.03 | 14.34 | 16.90 | 18.88 | 20.66 | 22.02 |
| $C_2H_2$ | 0.33 | 0.37 | 0.44 | 0.57 | 0.24 | 0.33 | 0.41 | 0.49 | 0.51 |
| $C_2H_4$ | 27.97 | 28.66 | 29.88 | 29.56 | 21.93 | 27.08 | 29.29 | 31.74 | 32.82 |
| $C_2H_6$ | 5.10 | 4.87 | 4.87 | 4.73 | 4.84 | 5.71 | 5.72 | 5.84 | 5.59 |
| $C_3H_4$ | 0.92 | 1.20 | 0.96 | 0.89 | 0.72 | 0.58 | 0.67 | 0.76 | 0.85 |
| $C_3H_6$ | 15.76 | 13.90 | 11.89 | 9.32 | 12.90 | 19.22 | 17.99 | 17.48 | 15.04 |
| $C_3H_8$ | 0.25 | 0.22 | 0.18 | 0.22 | 0.25 | 0.23 | 0.22 | 0.19 | 0.16 |
| $C_4H_6$ | 4.74 | 4.45 | 3.97 | 3.01 | 3.83 | 4.29 | 3.81 | 3.55 | 4.00 |
| i-$C_4H_8$ | 2.32 | 1.66 | 1.43 | 0.92 | 2.13 | 5.62 | 4.42 | 3.63 | 3.27 |
| $C_4H_8$ | 1.13 | 0.68 | 0.35 | 0.18 | 0.68 | 1.38 | 0.48 | 0.67 | 0.50 |
| RPG | 19.25 | 18.03 | 19.51 | 21.06 | 21.93 | 15.00 | 14.10 | 11.36 | 11.18 |
| FO[b] | 2.36 | 2.70 | 3.91 | 4.77 | 5.97 | 0.78 | 1.21 | 1.55 | 1.89 |
| $C_6H_6$[c] | 8.72 | 8.84 | 10.99 | 11.98 | 8.24 | 4.53 | 5.82 | 5.41 | 5.02 |
| $C_7H_8$[c] | 3.51 | 3.45 | 3.94 | 4.07 | 6.74 | 1.69 | 2.04 | 2.09 | 2.34 |
| $C_8H_{10}$[c] | 0.53 | 0.49 | 0.46 | 0.53 | 2.72 | 0.24 | 0.29 | 0.30 | 0.33 |
| Coke | 2.33 | 5.10 | 3.30 | 4.13 | 8.55 | 0.96 | 3.06 | 3.22 | 2.46 |

[a]Values in weight percent
[b]Fuel Oil
[c]Values contained in RPG (raw pyrolysis gasoline).
[d]This is the only test utilizing sulfur-spiking. 0.024 weight percent (240 ppm) of sulfur was added in the form of a thiophene.

Table 1 shows that the pyrolysis of hydrogenated coker gasoline at 836° C. (1,537° F.) results in considerably more ethylene production and considerably less coke as compared to pyrolysis of non-hydrogenated coker gasoline at the comparable temperature of 832° C. (1,530° F.). The coke yield in the test employing the non-hydrogenated coker gasoline was so great as to require an early termination of the pyrolysis test with that feedstock.

Table 1 shows that in general the coke yield from the hydrogenated coker gasoline is higher than it is from a pentane feedstock at a comparable temperature, but that spiking of the hydrogenated coker gasoline feedstock with 0.024 weight percent of sulfur (240 ppm by weight) in a pyrolysis test at 858° C. (1,576° F.) reduced the coke yield to a level which is nearly the same as that obtained with a pentane feedstock at the comparable temperature of 853° C. (1,567° F.).

It is further shown in Table 1 that sulfur spiking of the hydrogenated coker gasoline feedstock increases ethylene yield, i.e., it increases product selectivity towards ethylene. In this regard, Table 1 shows that in the case of both the pentane feedstock and the hydrogenated coker gasoline feedstock, ethylene yield increases progressively with increases in pyrolysis temperature, the only exception being a single test in which sulfur spiking was employed with a hydrogenated coker gasoline feedstock. In that test, an ethylene yield of 29.88 weight percent was achieved at a pyrolysis temperature of 858° C. (1,576° F.), and this ethylene yield is higher than the 29.56 weight percent ethylene yield achieved at a higher pyrolysis temperature of 877° C. (1,611° F.) employing a similar feedstock without sulfur spiking. This shows that sulfur spiking improved ethylene selectivity during pyrolysis cracking of the hydrogenated coker gasoline.

Table 2 shows that about one-third of the hydrogenated coker gasoline feedstock is cycloparaffinic, while it is stated above that only 5.46 volume percent of the pentane feedstock is cycloparaffinic. It is known that cycloparaffins are inferior to non-cyclic paraffins as an ethylene feedstock, in terms of both ethylene selectivity and coke formation. Furthermore, the boiling range of hydrogenated coker gasoline is higher than that of pentanes and it is known that relatively high boiling paraffins are inferior to lower boiling paraffins as an ethylene feedstock. In spite of the predicted high superiority of the pentane feedstock based upon these considerations, the 29.88 weight percent ethylene yield obtained upon pyrolysis of the hydrogenated coker gasoline feedstock at 858° C. (1,576° F.) employing sulfur spiking compares favorably with the 31.74 weight percent ethylene yield obtained with the pentane feedstock at the comparable pyrolysis temperature of 853° C. (1,567° F.). But most surprisingly, even though the coke yield from the hydrogenated coker gasoline in the other tests is generally considerably higher than the coke yield from the pentane feedstock at comparable temperatures, the 3.30 weight percent coke yield obtained with the hydrogenated coker gasoline feedstock in the test 858° C. (1,576° F.) employing sulfur spiking is essentially the same as the 3.22 weight percent coke yield obtained with the pentane feedstock in the test at the comparable temperature of 853° C. (1,567° F.). Since it is the magnitude of the coke yield that establishes the length of a cracking cycle in a coil pyrolysis operation, it is apparent that a sulfur-spiked hydrogenated coker gasoline feedstock can be blended with a pentane feedstock and thereby replace a portion of the pentane feedstock on an equal weight basis without essentially any reduction in cycle length due to coking.

Table 1 shows that a higher yield of aromatics was obtained from pyrolysis of the sulfur-spiked hydrogenated coker gasoline feedstock at 858° C. (1,576° F.) as compared to pyrolysis of pentanes at the comparable temperature of 853° C. (1,567° F.), indicating that the cyclic paraffinic content in the hydrogenated coker gasoline induces a much higher yield of aromatics than is produced with less cyclic pentane feedstock. While aromatics are frequently coke precursors, in the sulfur-spiking test of Table 1 conversion of the cycloparaffins was more selective to aromatics and less selective to coke. As long as aromatic products do not polymerize to coke, their production is advantageous since benzene, toluene and xylene are valuable commercial byproducts of the process. Thereby, replacement of a portion of pentane feedstock with hydrogenated coker gasoline on an equal weight basis at a given pyrolysis temperature can tend to diversify the mix of valuable products with reducing the cycle life of the pentane cracking operation.

A suitable pyrolysis feedstock of this invention can comprise hydrogenated cracked naphtha or coker naphtha or a mixture including both cracked and coker naphtha. Coker naphtha and cracked naphtha are generally similar to each other in composition and therefore a blend comprising coker naptha and cracked naphtha constitutes an advantageous feedstock for the naphtha hydrogenation operation. The naphtha stream can comprise mostly material boiling within the range 80° to 450° F. (27° to 323° C.). A suitable hydrogenation catalyst comprises tungsten and/or molybdenum and a Group VIII metal on a highly porous, non-cracking supporting material. Alumina is the preferred supporting material but other porous, non-cracking supports, such as magnesia-alumina, can be employed. Tungsten and/or molybdenum is preferably, but not necessarily, the supported catalytic entity present in greatest amount and can generally comprise about 1 to about 25 weight percent of the catalyst or, preferably, about 15 to 22 weight percent of the catalyst. The Group VIII metal is preferably nickel and can comprise generally about 1 to about 25 weight percent of the catalyst, or, preferably, about 3 to about 22 weight percent of the catalyst. These metal contents are based on elemental metal. However, the catalytic metals will generally be present first as metal oxides and will be converted to metal sulfides before or during use. Suitable hydrogenation conditions include a temperature in the range 500° to 850° F. (260° to 454° C.), generally, and 625° to 700° F. (329° to 371° C.), preferably; and a hydrogen pressure in the range 400 to 2500 psi (28 to 175 kg/cm$^2$), generally, and 500 to 1500 psi (35 to 105 kg/cm$^2$), preferably. The liquid hourly space velocity can be between 0.25 and 4 or preferably, between 0.5 and 1.5. The circulation rate of hydrogen can be between 2,000 and 10,000 SCF/B (54 and 126 SCM/100L). Hydrogen consumption can be between about 400 and 1,000 SCF/B (7.2 and 18 SCM/100L), generally, but more usually will be between about 500 and 800 SCF/B (9 and 14.4 SCM/100L).

The cracked naphtha or coker naphtha stream flowing to the naphtha hydrogenation zone will usually contain more than about 35 volume percent of olefins plus aromatics. The hydrogenation effluent stream will contain less than 5 volume percent of olefins plus aromatics, generally, and preferably less than 2 volume percent of olefins plus aromatics. Very little hydrocracking or ring opening occurs in the naphtha hydrogenation zone so that naphthenes and aromatics will be generally converted to cycloparaffins rather than to non-cyclic paraffins and not more than 10 or 20 volume percent of the feed naphtha stream will be converted to material boiling below the IBP of the feed naphtha stream. The hydrogenated naphtha will generally contain at least 10 or 20 volume percent of cycloparaffins. The naphtha will be desulfurized under hydrogenation conditions so that hydrogenated naphtha will generally contain less than 10 ppm by weight of sulfur, or even less than 5 ppm by weight of sulfur.

We claim:

1. A process comprising catalytically hydrotreating a feed naphtha stream containing olefins, naphthenes and aromatics to produce a hydrogenated naphtha stream containing less than 10 ppm by weight of sulfur and less than 5 volume percent of olefins plus aromatics and more than 10 volume percent of cycloparaffins, passing said hydrogenated naphtha stream to a pyrolysis zone, also passing to said pyrolysis zone a sulfur compound in an amount sufficient to increase the sulfur content based on hydrogenated naphtha to between about 20 and about 1,000 ppm by weight, operating said pyrolysis zone without added molecular hydrogen and without a catalyst at a temperature between 1,300° and 2,300° F. for a residence time between 0.05 and 2 seconds to produce a pyrolysis product containing ethylene and ethane wherein the ethylene yield is more than twice the ethane yield on a weight basis.

2. The process of claim 1 wherein said feed naphtha stream primarily comprises materials boiling within the range 80° to 450° F.

3. The process of claim 1 wherein said hydrogenated naphtha stream contains less than 2 volume percent of olefins plus aromatics.

4. The process of claim 1 wherein said hydrogenated naphtha stream contains more than 20 volume percent of cycloparaffins.

5. The process of claim 1 wherein said hydrogenated naphtha stream contains more than 30 volume percent of cycloparaffins.

6. The process of claim 1 wherein the sulfur content based on hydrogenated naphtha is increased to between 50 to 800 ppm by weight.

7. The process of claim 1 wherein the pyrolysis temperature is between 1,400° and 2,000° F.

8. The process of claim 1 wherein the pyrolysis temperature is between 1,430° and 1,850° F.

9. The process of claim 1 wherein said pyrolysis residence time is between 0.05 and 0.05 seconds.

10. The process of claim 1 wherein said pyrolysis product is quenched to a temperature below 1,300° F. immediately upon leaving said pyrolysis zone.

11. The process of claim 1 wherein the ethylene yield is more than three times the ethane yield, on a weight basis.

12. The process of claim 1 wherein the ethylene yield is more than four times the ethane yield, on a weight basis.

13. The process of claim 1 wherein a stream containing paraffins from the $C_2$ to $C_5$ group and containing less than 10 volume percent of cycloparaffins is also passed to said pyrolysis zone.

14. The process of claim 1 wherein said feed naphtha stream comprises straight run naphtha.

15. The process of claim 1 wherein said feed naphtha stream comprises thermally cracked naphtha.

16. The process of claim 1 wherein said feed naphtha stream comprises catalytically cracked naphtha.

17. The process of claim 1 wherein said feed naphtha stream comprises coker naphtha.

18. The process of claim 1 wherein said pyrolysis zone comprises a coil in a furnace.

19. The process of claim 1 wherein a stream of hot inert solids is used to supply heat to said pyrolysis zone.

20. The process of claim 1 wherein a dispersant gas is supplied to said pyrolysis zone.

21. The process of claim 1 wherein said hydrotreating step not more than 20 volume percent of said feed naphtha stream is converted to material boiling below the IPB of said feed naphtha stream.

22. The process of claim 1 wherein the hydrotreating catalyst comprises tungsten and Group VIII metal.

23. The process of claim 1 wherein the hydrotreating catalyst comprises molybdenum and Group VIII metal.

24. The process of claim 1 wherein the hydrotreating catalyst comprises tungsten and molybdenum and Group VIII metal.

25. The process of claim 1 wherein the sulfur content based on hydrogenated naphtha is increased to between about 75 to about 500 ppm by weight.

* * * * *